US007425039B2

(12) United States Patent
Lin

(10) Patent No.: US 7,425,039 B2
(45) Date of Patent: Sep. 16, 2008

(54) BODY-SUPPORTING DEVICE

(76) Inventor: Peter Lin, No. 16, Lane 207, Tsu Tzu Road, Nan Tou City, Nan Tou, Hsien (TW)

( * ) Notice: Subject to any disclaimer, the term of this patent is extended or adjusted under 35 U.S.C. 154(b) by 20 days.

(21) Appl. No.: 11/618,322

(22) Filed: Dec. 29, 2006

(65) Prior Publication Data

US 2008/0157580 A1 Jul. 3, 2008

(51) Int. Cl.
*A47C 7/02* (2006.01)

(52) U.S. Cl. ..... 297/452.56

(58) Field of Classification Search ..... 297/452.38, 297/452.56, 391, 452.63, 452.64, 440.2, 297/440.11, 440.22
See application file for complete search history.

(56) References Cited

U.S. PATENT DOCUMENTS 662,647 A * 11/1900 Howe ..... 160/179
6,378,944 B1 * 4/2002 Weisser ..... 297/440.11
6,540,950 B1 * 4/2003 Coffield ..... 264/257
6,722,741 B2 * 4/2004 Stumpf et al. ..... 297/452.3
7,066,550 B1 * 6/2006 Su ..... 297/440.22
2004/0124689 A1 * 7/2004 Numa et al. ..... 297/452.56
2005/0057085 A1 * 3/2005 Wu ..... 297/452.56
2005/0248205 A1 * 11/2005 Neil et al. ..... 297/452.18

OTHER PUBLICATIONS

Taiwanese Patent M262101, Apr. 21, 1994, 8 pages.

* cited by examiner

*Primary Examiner*—Milton Nelson, Jr.
(74) *Attorney, Agent, or Firm*—Alan Kamrath; Kamrath & Associates PA

(57) ABSTRACT

A body-supporting device includes a tray, a net and a frame. The tray includes a margin and a groove in the margin. The groove gets narrower downwardly. The net includes a margin. The frame includes a first rib for inserting the margin of the net into the groove of the tray and a second rib for pressing the margin of the net against the margin of the tray. The first rib gets narrower downwardly. Fasteners are driven into the first rib of the frame through the margin of the tray. The sandwiching of the margin of the net between the first rib of the frame and the margin of the tray gets firmer as the fasteners get tighter in the first rib of the frame.

5 Claims, 5 Drawing Sheets

BODY-SUPPORTING DEVICE

BACKGROUND OF INVENTION

1. Field of Invention

The present invention relates to a chair and, more particularly, to a body-supporting device such as a seat, a backrest and a headrest for use in a chair.

2. Related Prior Art

Chairs are important for people and more so for those who spend most of their time sitting and working. Manufacturers have been trying to come up with comfortable chairs. However, conventional chairs exert a lot of considerable pressure on users' hips and backs and cause heat to accumulate beneath the users' hips and behind the users' backs.

Nets have been used in seats, backrests and headrests. The nets exert proper pressure on the users' hips and backs and allow heat to disperse from the users' hips and backs. Conventionally, screws are used to connect the nets to tray-like elements of the seats, backrests and headrests. This is, however, difficult since the nets define meshes.

According to Taiwanese Patent M262101, a net 6 is provided for a seat or backrest. The net 6 is made with tubular portions 61 by adhesion. Pipes 9 are inserted into the tubular portions 61 of the net 6. The pipes 9 are connected to a frame 5 of a chair. It is, however, difficult and costly to make the tubular portions 61 of the net 6 by adhesion. The tubular portions 61 of the nets 6 would easily be torn. Moreover, the nets 6 and the pipes 9 are chair-specific. That is, different nets 6 with different tubular portions 61 and different pipes 9 are made for different chairs. This entails high costs in preparing and storing the parts of the chairs.

The present invention is therefore intended to obviate or at least alleviate the problems encountered in the prior art.

SUMMARY OF INVENTION

According to the present invention, a body-supporting device includes a tray, a net and a frame. The tray includes a margin and a groove in the margin. The groove gets narrower downwardly. The net includes a margin. The frame includes a first rib for inserting the margin of the net into the groove of the tray and a second rib for pressing the margin of the net against the margin of the tray. The first rib gets narrower downwardly. Fasteners are driven into the first rib of the frame through the margin of the tray. The sandwiching of the margin of the net between the first rib of the frame and the margin of the tray gets firmer as the fasteners get tighter in the first rib of the frame.

An advantage of the body-supporting device of the present invention is firm sandwiching of the margin of the net between the frame and the margin of the tray.

Another advantage of the body-supporting device of the present invention is even stress in the net.

Still another advantage of the body-supporting device of the present invention is easy preparation of the net.

Still another advantage of the body-supporting device of the present invention is easy assembly.

Still another advantage of the body-supporting device of the present invention is a low cost.

Other advantages and features of the present invention will become apparent from the following description referring to the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
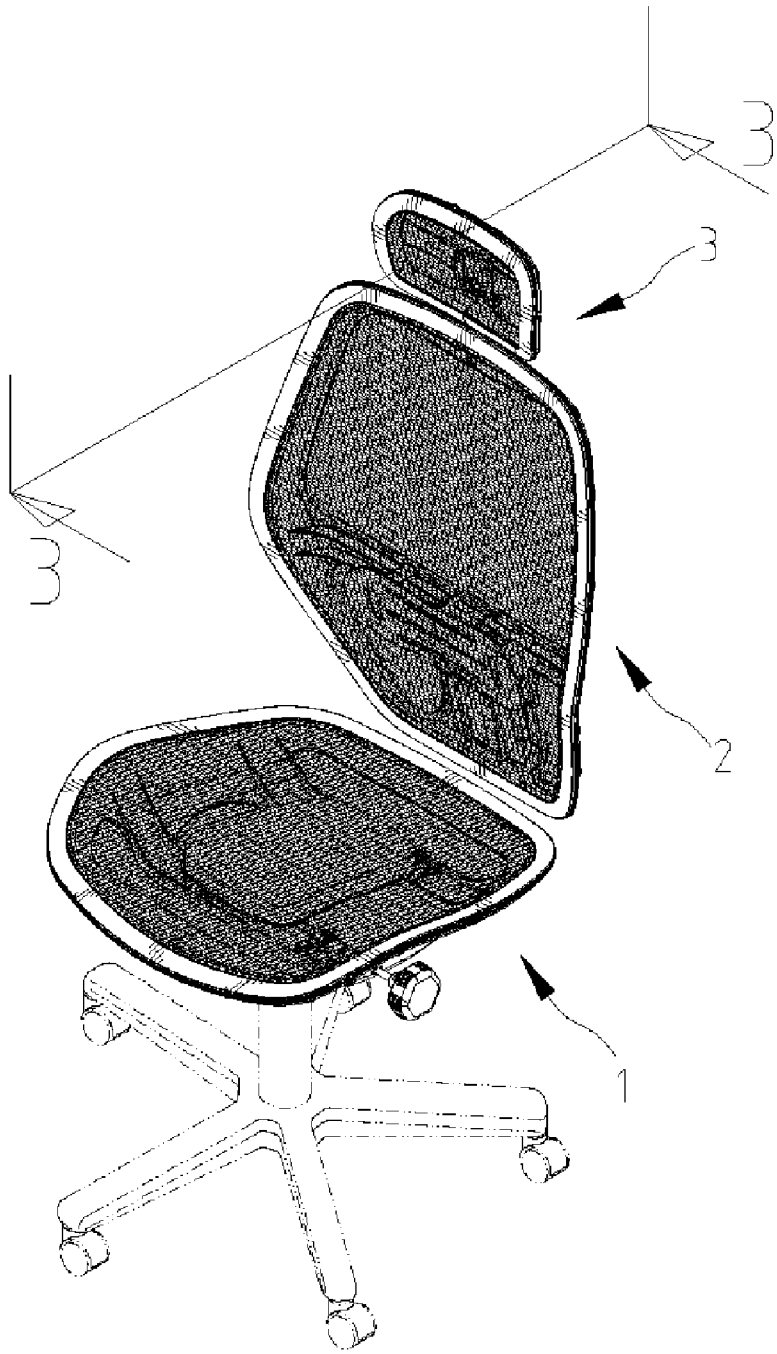
FIG. 1 is a perspective view of a chair including body-supporting devices according to the preferred embodiment of the present invention.
Figure 2:
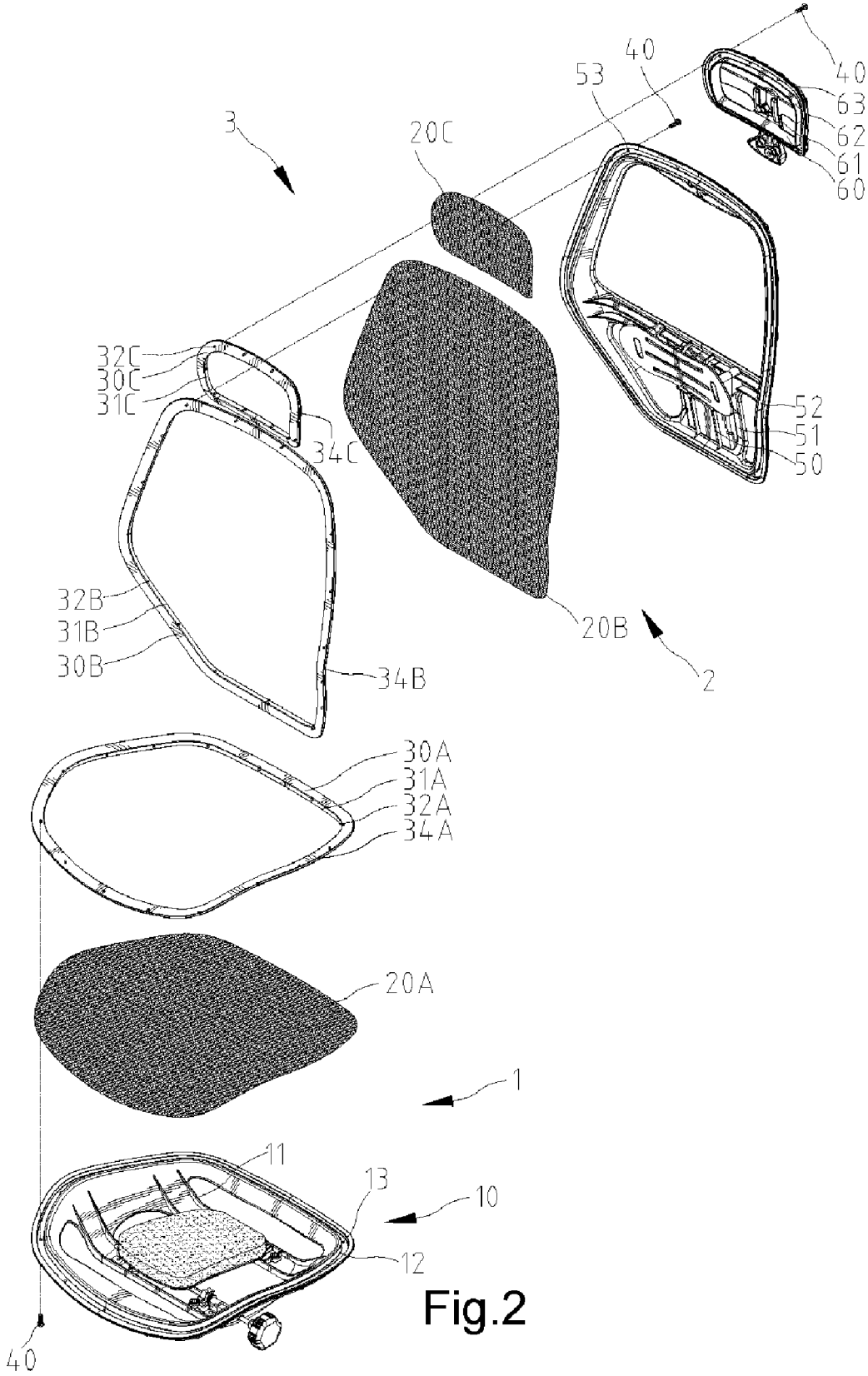
FIG. 2 is an exploded view of the body-supporting devices shown in FIG. 1.

Referring to FIG. 1, a chair includes a seat 1, a backrest 2 and a headrest 3 according to the preferred embodiment of the present invention. Each of the seat 1, the backrest 2 and the headrest 3 can be referred to as the "body-supporting device."

The seat 1 includes a tray 10, a net 20A and a frame 30A. The tray 10 defines a space 111 in the center, a groove 12 around the space 111 and apertures 13 in communication with the groove 12. The groove 12 gets narrower downwardly.

The net 20A is cut according to the tray 10. The area of the net 20A is intended to be larger than an area defined by the tray 10.

The frame 30A is made according to the groove 12. The frame 30A includes a first rib 31A and a second rib 34A both on the bottom. The first rib 31A gets narrower downwardly. Screw holes 32A are defined in the rib 31A of the frame 30A.

Figure 3:
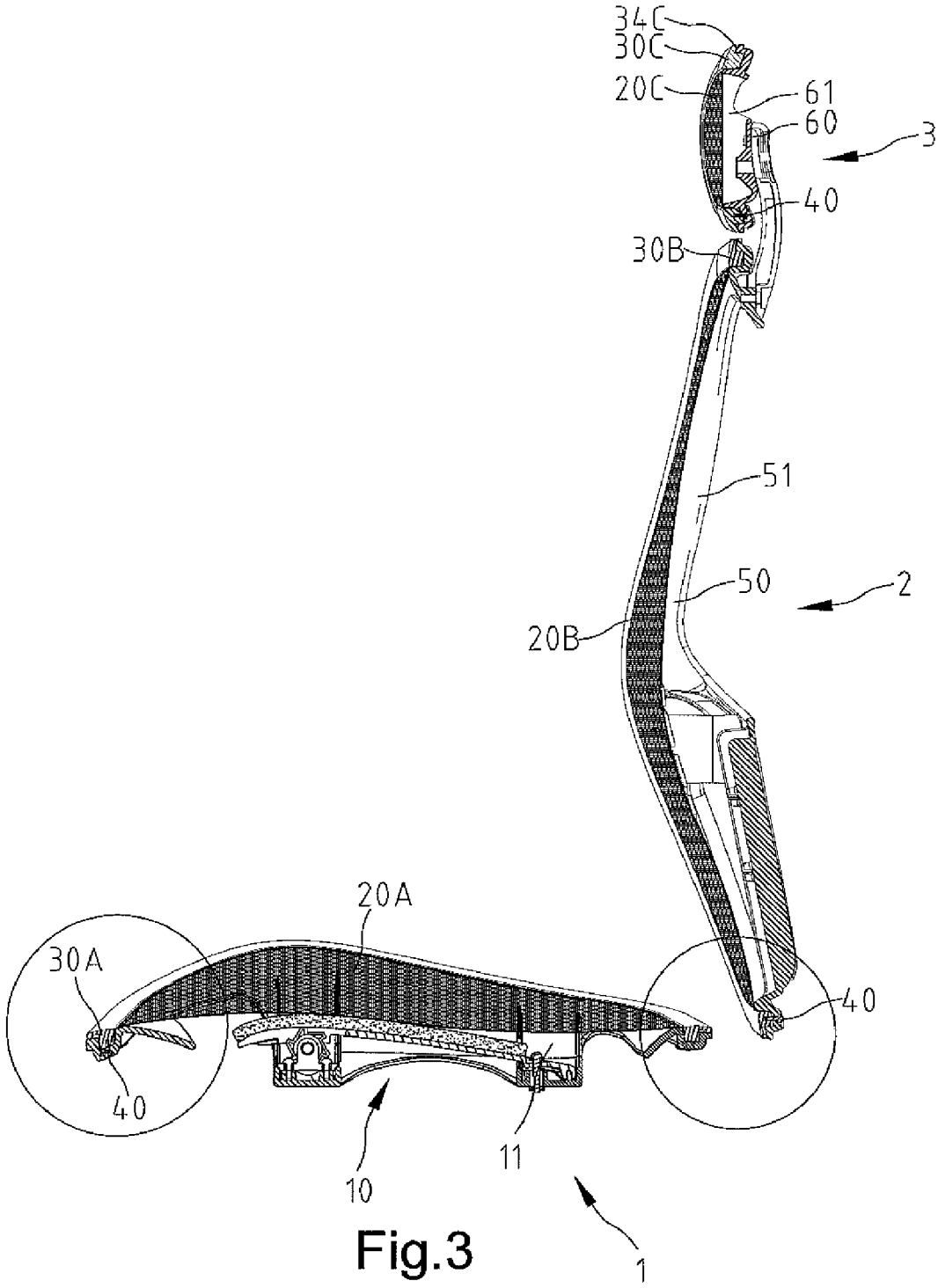
FIG. 3 is a cross-sectional view of the body supporting devices shown in FIG. 1.

Referring to FIG. 3, the first rib 31A of the frame 30A and a first portion of the margin of the net 20A are inserted into the groove 12. The first portion of the margin of the net 20A is sandwiched between the first rib 31A of the frame 30A and the margin 15 of the tray 10. Fasteners 40 such as threaded bolts and screws are driven into the screw holes 32A through the apertures 13. Thus, the first portion of the margin of the net 20A is firmly sandwiched between the first rib 31A of the frame 30A and the margin 15 of the tray 10. Stress exists evenly in the net 20A. Then, the redundant portion of the net 20A is cut off.

A second portion of the margin of the net 20A is sandwiched between the second rib 34A of the frame 30 and the margin 15 of the tray 10. Thus, the second portion of the margin of the net 20A is well concealed and pressed.

There is a gap between the ribs 31A and 34A of the frame 30A. The gap prevents the frame 30A from contacting a portion of the margin 15 near the groove 12, thus avoiding the flapping of the frame 30A.

Figure 4:
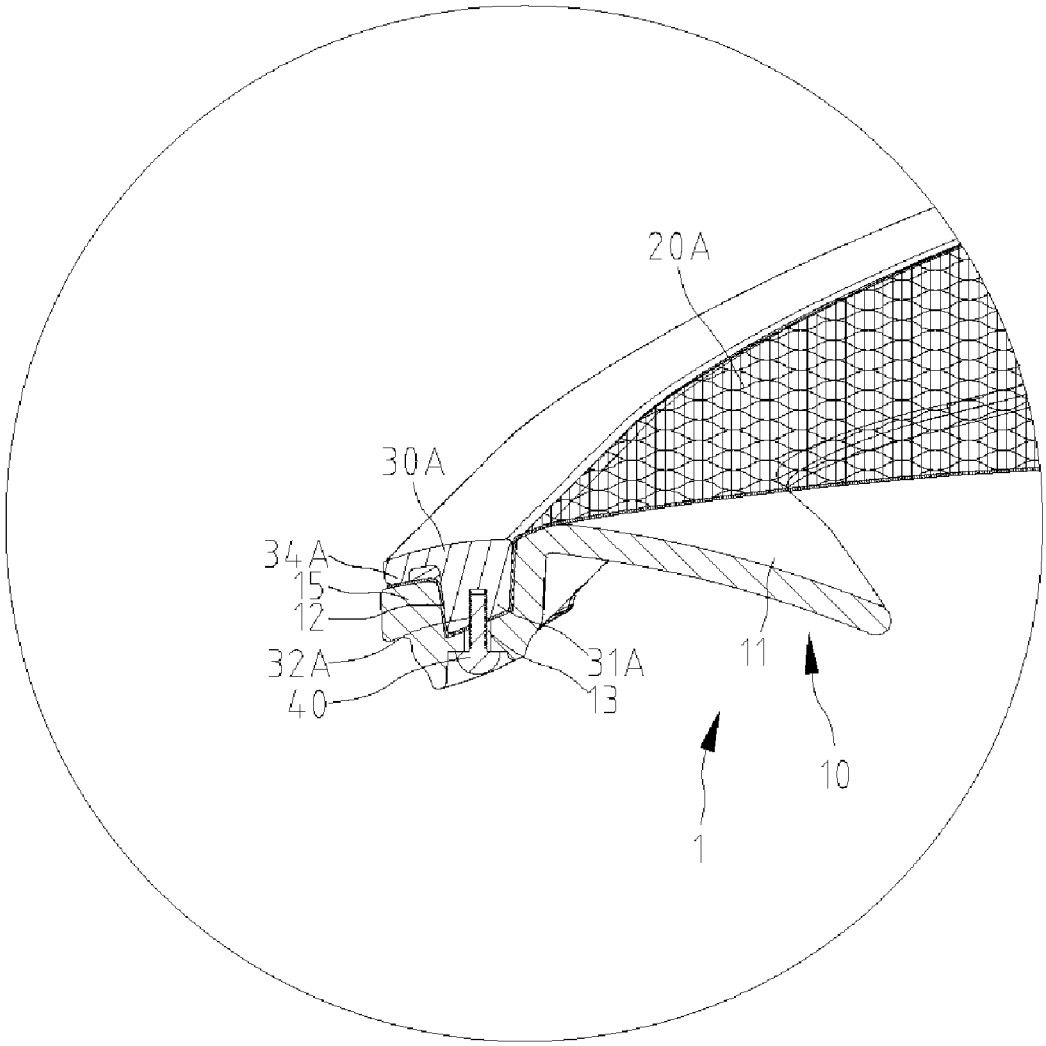
FIG. 4 is an enlarged partial view of the body-supporting devices shown in FIG. 3.
Figure 5:
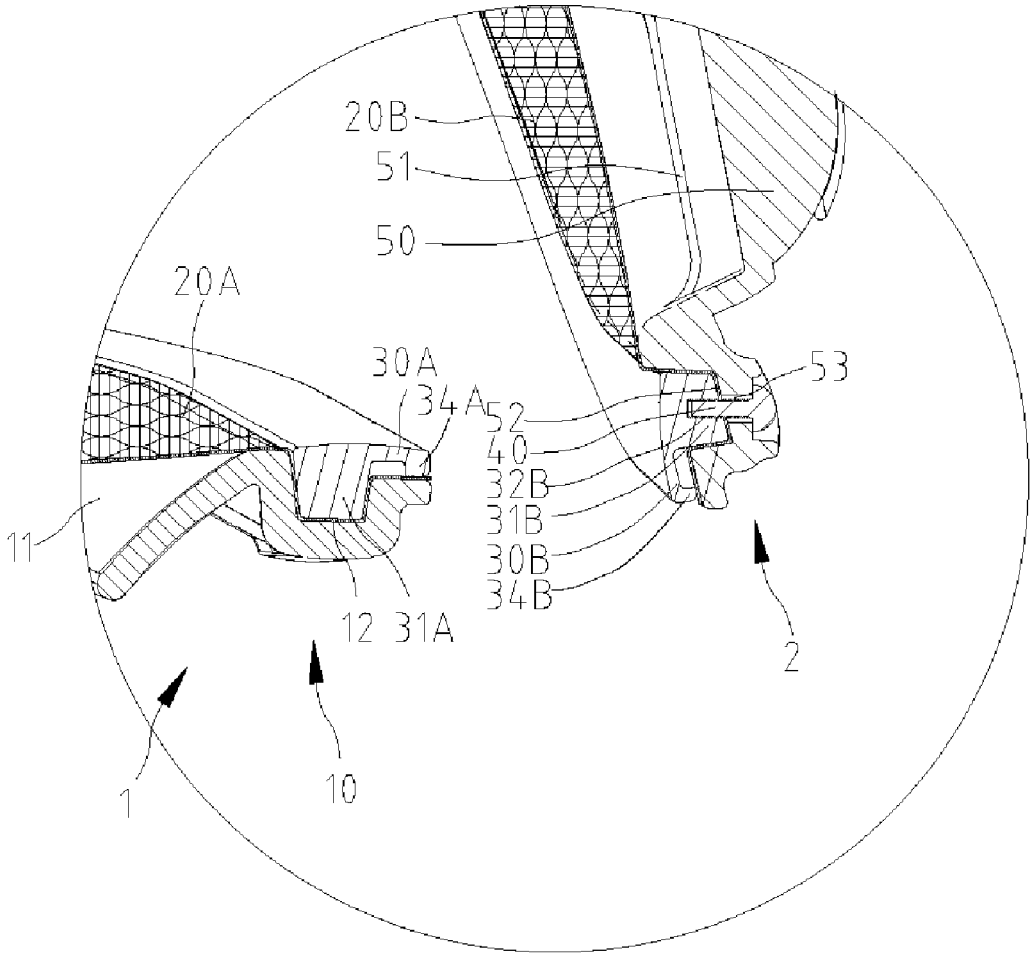
FIG. 5 is another enlarged partial view of the body-supporting devices shown in FIG. 3.

Referring to FIGS. 4 and 5, the first rib 31A of the frame 30A is tapered, and the groove 12 is accordingly tapered. Thus, the rib 31A of the frame 30A and the margin of the net 20A can easily be pressed into the groove 12. In addition, the sandwiching of the first portion of the margin of the net 20A between the first rib 31A of the frame 30A and the margin of the tray 10 gets firmer as the fasteners 40 get tighter in the screw holes 32A.

The structure of the backrest 2 is like that of the seat 1. Therefore, the backrest 2 includes a tray 50, a net 20B and a frame 30B similar to the tray 10, the net 20A and the frame 30A, respectively.

The tray 50 defines a space 51, a groove 52 and apertures 53 similar to the space 11, the groove 12 and the apertures 13, respectively.

The frame 30B includes a first rib 31B, a second rib 34B and screw holes 32B like the first rib 31A, 34A and the screw holes 32A, respectively.

The structure of the headrest 3 is like that of the seat 1. Therefore, the headrest 3 includes a tray 60, a net 20C and a frame 30C similar to the tray 10, the net 20A and the frame 30A, respectively.

The tray 60 defines a space 61, a groove 62 and apertures 63 similar to the space 11, the groove 12 and the apertures 13, respectively.

The frame 30C includes a first rib 31C, a second rib 34C and screw holes 32C like the first rib 31A, the second rib 34A and the screw holes 32A, respectively.

The body-supporting device according to the present invention exhibits several advantages. Firstly, the margin of the net is firmly sandwiched between the frame and the margin of the tray. Secondly, stress exists evenly in the net. Thirdly, the net is simply cut and used without having to undergo a complicated process before it can be used. Fourthly, the assembly is easy. Fifthly, the cost is low.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A body-supporting device comprising:

a tray comprising a margin and a groove in the margin, wherein the groove gets narrower downwardly;

a net comprising a margin;

a frame comprising a first rib for inserting the margin of the net into the groove of the tray so that the margin of the net is sandwiched between the first rib and the groove, and a second rib for pressing the margin of the net against the margin of the tray so that the margin of the net is sandwiched between the second rib and the groove, wherein the first rib gets narrower downwardly; and a plurality of fasteners driven into the first rib of the frame through the margin of the tray so that sandwiching of the margin of the net between the first rib of the frame and the margin of the tray gets firmer as the fasteners get tighter in the first rib of the frame.

2. The body-supporting device according to claim 1 wherein the tray defines apertures in communication with the groove, and the frame defines screw holes for receiving the fasteners through the apertures.

3. The body-supporting device according to claim 1 wherein the body-supporting device is a seat.

4. The body-supporting device according to claim 1 wherein the body-supporting device is a backrest.

5. The body-supporting device according to claim 1 wherein the body-supporting device is a headrest.

* * * * *